US011864648B2

(12) United States Patent
Gelber

(10) Patent No.: US 11,864,648 B2
(45) Date of Patent: Jan. 9, 2024

(54) OVERHEAD STORAGE UNIT WITH PIVOTING STORAGE CONTAINERS

(71) Applicant: 143046 Canada Inc., Montreal (CA)

(72) Inventor: Eleaizer Gelber, Montreal (CA)

(73) Assignee: 143046 CANADA INC., Montreal (CA)

( * ) Notice: Subject to any disclaimer, the term of this patent is extended or adjusted under 35 U.S.C. 154(b) by 0 days.

(21) Appl. No.: 17/754,497

(22) PCT Filed: Oct. 2, 2020

(86) PCT No.: PCT/CA2020/051320

§ 371 (c)(1),
(2) Date: Apr. 4, 2022

(87) PCT Pub. No.: WO2021/062550

PCT Pub. Date: Apr. 8, 2021

(65) Prior Publication Data

US 2022/0361665 A1 Nov. 17, 2022

Related U.S. Application Data

(60) Provisional application No. 62/910,549, filed on Oct. 4, 2019.

(51) Int. Cl.
*A47B 51/00* (2006.01)
*A47B 46/00* (2006.01)

(52) U.S. Cl.
CPC ..... *A47B 51/00* (2013.01); *A47B 46/005* (2013.01); *A47B 2051/005* (2013.01)

(58) Field of Classification Search
CPC .. A47B 51/00; A47B 2051/005; A47B 46/005
(Continued)

(56) References Cited

U.S. PATENT DOCUMENTS 380,490 A 4/1888 Jewell
415,056 A 11/1889 Phillips
(Continued)

FOREIGN PATENT DOCUMENTS

DE 4223048 1/1994
EP 1820420 8/2007
(Continued)

OTHER PUBLICATIONS

International Search Report dated Oct. 24, 2017.
(Continued)

*Primary Examiner* — Daniel J Rohrhoff
(74) *Attorney, Agent, or Firm* — Norton Rose Fulbright Canada LLP

(57) ABSTRACT

An overhead storage unit includes a guide member having a first horizontal segment mountable within an overhead storage area, a second vertical segment mountable below the overhead storage area, and a curved segment extending between the first and second segments. A storage assembly has storage containers each connected to at least one other storage container at common pivots. The storage containers displace along the guide member between a stored position and an accessible position. Each storage container pivots relative to an adjacent storage container on the common pivot as the storage containers are displaced between the stored and accessible positions. The storage containers are disposed within the overhead storage area and have a first orientation in the stored position. The storage containers are disposed below the overhead storage area and have a second orientation different from the first orientation in the accessible position.

19 Claims, 6 Drawing Sheets

(58) Field of Classification Search
USPC ..... 312/246, 247
See application file for complete search history.

(56) References Cited

U.S. PATENT DOCUMENTS 478,566 A 7/1892 Caspar
479,857 A 8/1892 Tettelbach
481,586 A 8/1892 Paul
581,803 A 5/1897 Armstrong
1,095,363 A 5/1914 Weiss
1,137,074 A 4/1915 Morris
1,529,601 A 3/1925 Lyons
2,506,086 A 5/1950 Jess
2,547,597 A * 4/1951 Roggero ..... A47B 51/00 312/307
2,555,254 A * 5/1951 Stebbins ..... A47B 46/00 312/246
2,679,446 A 5/1954 Weil
2,703,643 A * 3/1955 Parsons ..... A47B 63/067 211/121
2,839,349 A 6/1958 Culver
3,331,645 A * 7/1967 Vercellotti ..... A47B 49/002 211/74
3,464,749 A 9/1969 Bishop
3,524,692 A 8/1970 Preston
3,663,971 A 5/1972 Bonhote
3,720,451 A * 3/1973 Anders ..... A47B 63/067 198/798
3,770,133 A * 11/1973 Kolker ..... E04H 6/005 410/3
3,814,366 A 6/1974 Staifer
3,973,812 A 8/1976 Poltorak
4,117,939 A 10/1978 Haddock
4,134,629 A 1/1979 Hansen
4,150,861 A 4/1979 Dufrancatel
4,374,537 A 2/1983 Lindbergh
4,723,680 A 2/1988 Carroll
4,725,108 A 2/1988 Wilson
4,890,722 A * 1/1990 Gough ..... B65G 17/485 198/712
5,183,162 A * 2/1993 Ritzenthaler ..... B62H 3/12 211/121
5,221,009 A 6/1993 Ritzenthaler
5,242,219 A 9/1993 Tomaka
5,249,858 A 10/1993 Nusser
5,294,006 A 3/1994 Deschino
5,383,628 A 1/1995 Harriehausen
5,474,189 A 12/1995 Peterson
5,475,949 A 12/1995 McCoy
5,499,584 A 3/1996 Taylor
5,649,751 A 7/1997 Longhurst et al.
5,758,782 A 6/1998 Rupert
5,772,295 A 6/1998 Sundmark
5,857,756 A 1/1999 Fehre
5,934,615 A 8/1999 Treichler et al.
5,957,558 A * 9/1999 Quade ..... A47B 88/48 312/246
6,039,422 A 3/2000 Butters
6,095,344 A 8/2000 White
6,250,728 B1 6/2001 Thorp
6,336,692 B1 1/2002 Snyder
6,367,898 B1 * 4/2002 Jobe ..... A47B 51/00 312/246
6,550,878 B2 4/2003 Nott et al.
6,733,095 B1 5/2004 Rieb
6,851,376 B2 2/2005 D'Agostino
6,854,815 B1 * 2/2005 Smith ..... A47B 49/008 211/121
7,178,887 B2 2/2007 Steadman
7,246,865 B1 7/2007 Merrel, II
7,325,785 B2 2/2008 Krengel
7,770,986 B1 8/2010 Simaitis
8,136,897 B2 3/2012 Mascari
8,157,108 B1 4/2012 Waldrop
8,210,370 B2 7/2012 Botkin
8,414,093 B2 4/2013 Moran
8,424,983 B1 4/2013 Strauss
8,443,991 B1 * 5/2013 Ivey, III ..... A47B 51/00 211/116
8,636,251 B2 1/2014 Mayer et al.
8,641,156 B2 2/2014 Chow
8,733,860 B1 * 5/2014 Burke ..... B65G 1/127 312/134
8,814,490 B2 8/2014 Inui
8,863,323 B2 10/2014 Knapp et al.
8,926,031 B2 1/2015 Belton
8,950,592 B1 2/2015 Greenblatt et al.
8,985,344 B2 3/2015 Arson
8,991,948 B2 3/2015 Marsters
9,044,106 B1 * 6/2015 Smith ..... A47F 3/06
9,055,813 B2 6/2015 Telthörster
9,392,912 B2 7/2016 Haddad
9,414,672 B1 8/2016 Flynn
9,578,993 B2 2/2017 Stafford et al.
9,645,569 B1 * 5/2017 Hall ..... B65G 1/137
9,738,386 B2 8/2017 Walton et al.
9,980,564 B2 5/2018 Roberts
10,000,287 B2 6/2018 Claflin et al.
10,085,552 B2 10/2018 Boguslawski
10,315,767 B2 6/2019 Claflin et al.
10,322,877 B2 * 6/2019 Belardinelli ..... B65G 1/12
10,846,675 B1 * 11/2020 Smith ..... G07F 17/12
10,925,391 B1 2/2021 Stilley
2002/0079792 A1 6/2002 Nott et al.
2005/0102746 A1 5/2005 Wright et al.
2005/0173202 A1 8/2005 Shaw
2006/0066188 A1 3/2006 Crawford
2006/0108303 A1 5/2006 Rupert
2006/0192468 A1 8/2006 Gardner
2007/0294953 A1 12/2007 Guillen
2008/0182224 A1 7/2008 Ahearn
2009/0284110 A1 11/2009 Mascari
2010/0108627 A1 5/2010 Lupinacci
2013/0015145 A1 1/2013 Koepke
2015/0145393 A1 5/2015 Young
2016/0235194 A1 8/2016 Baranski
2017/0290422 A1 * 10/2017 Hall ..... A47B 77/08
2018/0281956 A1 11/2018 Fischer
2019/0029420 A1 * 1/2019 Poussuet ..... A47B 46/005
2021/0045527 A1 * 2/2021 Gelber ..... A47B 46/005
2021/0393028 A1 * 12/2021 Haylow ..... A47B 91/02

FOREIGN PATENT DOCUMENTS

EP 1925236 A 5/2008
EP 1925236 A1 5/2008
EP 1820420 B1 10/2008
FR 2903872 A1 1/2009
JP 4895927 11/1973
JP 5754669 4/1982
JP S5754669 A 4/1982
JP 5785948 5/1982
JP 58196633 12/1983
JP 03128781 B2 5/1991
JP 0849403 2/1996
JP 08117036 11/1996
JP 2000079024 3/2000
JP 2000342353 12/2000
JP 2001029146 2/2001
JP 2001029146 A 2/2001
JP 2012000261 A 1/2012
NL 7712702 5/1979
WO 0042886 7/2000
WO 2018137017 A1 8/2018

OTHER PUBLICATIONS

Extended European Search Report for EP application No. 17893588.8 dated Aug. 7, 2020.
Translation of Office Action dated Jan. 28, 2021, JP2019-562447.
International Search Report, PCT/CA2020/051320, dated Dec. 30, 2020.

(56) References Cited

OTHER PUBLICATIONS

International Search Report and Written Opinion dated Dec. 30, 2020, International PCT Application CT/CA2020/051320.
International Search Report and Written Opinion, PCT/CA2021/051556, dated Jan. 25, 2022.

* cited by examiner

OVERHEAD STORAGE UNIT WITH PIVOTING STORAGE CONTAINERS

CROSS-REFERENCE TO RELATED APPLICATIONS

This application is a national phase entry of PCT/CA2021/062550, filed Oct. 2, 2020, which claims priority to U.S. provisional patent application 62/910,549 filed Oct. 4, 2019, the entire contents of both of which are incorporated by reference herein. Reference is also made to PCT patent application number PCT/CA2017/050087 filed Jan. 27, 2017 and having publication number WO 2018/137017, the entire contents of which are also incorporated by reference herein.

TECHNICAL FIELD

The application relates generally to the storage of items and, more particularly, to overhead storage units.

BACKGROUND

In many jurisdictions, interior real estate is priced per unit of available floor space (e.g. $/ft$^2$). This pricing model encourages occupants to maximise the number of features that can comfortably be provided within a minimum area of floor space, resulting in a reduction of features and decreased comfort.

In urban residential areas, relatively high unit floor space costs incentivize the construction of smaller living units. Developers of these smaller living units still wish to offer their occupants features and accessories associated with larger living areas, in order to accommodate the occupant's lifestyle. However, providing such features and accessories is difficult because less space is available in these smaller living units.

SUMMARY

There is disclosed an overhead storage unit, comprising: a guide member having a first horizontal segment mountable within an overhead storage area, a second vertical segment mountable below the overhead storage area, and a curved segment extending between the first and second segments; and a storage assembly having a plurality of storage containers each connected to at least one other storage container at common pivots, the storage containers mounted to the guide member and displaceable therealong to be raised and lowered between a stored position and an accessible position, each storage container pivoting relative to an adjacent storage container on the common pivot as the storage containers are displaced between the stored and accessible positions, the storage containers disposed within the overhead storage area and having a first orientation in the stored position, and the storage containers disposed below the overhead storage area and having a second orientation different from the first orientation in the accessible position.

There is disclosed a residential living unit, comprising: an overhead storage area; and an overhead storage unit, comprising: an elongated guide member having a first horizontal segment mounted within the overhead storage area, a second vertical segment mounted below the overhead storage area, and a curved segment extending between the first and second segments; and a storage assembly having a plurality of storage containers each connected to at least one other storage container at common pivots, the storage containers mounted to the guide member and displaceable therealong to be raised and lowered between a stored position and an accessible position, each storage container pivoting relative to an adjacent storage container on the common pivot as the storage containers are displaced between the stored and accessible positions, the storage containers disposed within the overhead storage area and having a first orientation in the stored position, and the storage containers disposed below the overhead storage area and having a second orientation different from the first orientation in the accessible position There is disclosed a method of storing items in an overhead storage area, comprising: loading the items in storage containers being interconnected and having an orientation beneath the overhead storage area; and raising the storage containers to be stored within the overhead storage area by upwardly displacing the storage containers along a pre-defined path, upward displacement of the storage containers changing the orientation of the storage containers to be different from the orientation when loading the storage containers, each storage container pivoting relative to an adjacent interconnected storage container about a pivot axis common to both storage containers during upward displacement thereof.

DESCRIPTION OF THE DRAWINGS

Reference is now made to the accompanying figures in which.

DETAILED DESCRIPTION

Figure 1A:
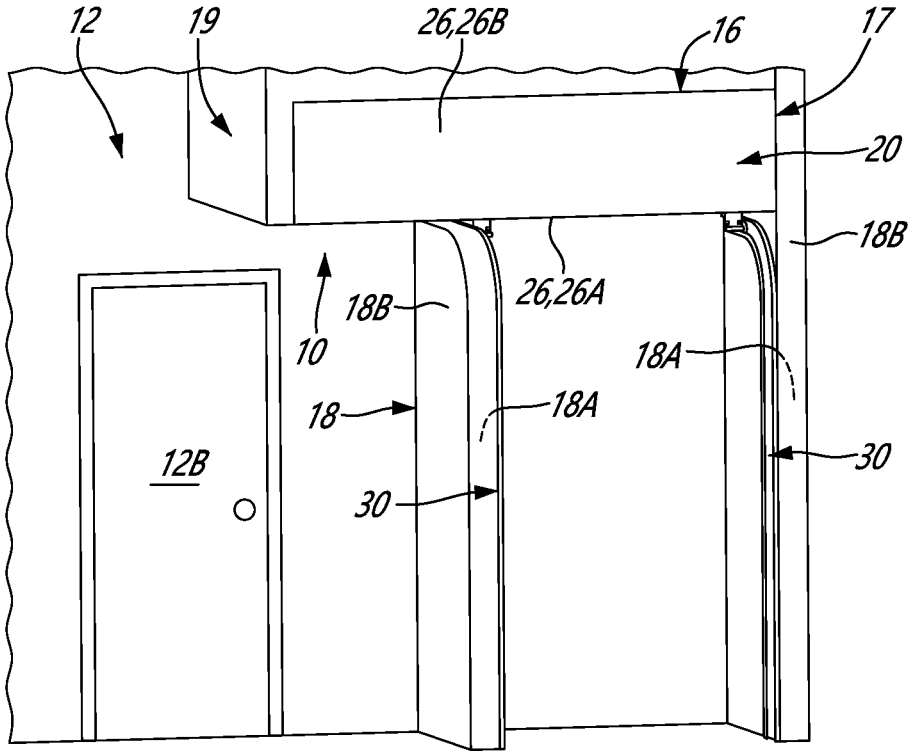
FIG. 1A is a perspective view of a residential living unit having an overhead storage unit.
Figure 1B:
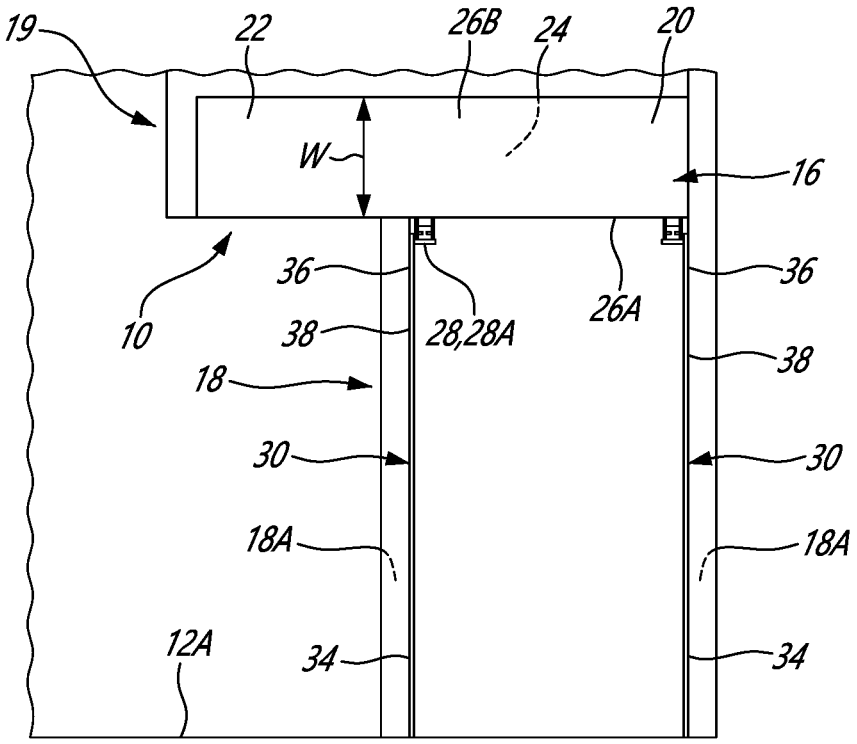
FIG. 1B is a perspective view of the overhead storage unit of FIG. 1A being shown in a stored position.

FIGS. 1A and 1B illustrate an overhead storage unit 10 provided in a residential living unit 12. In the depicted embodiment, the living unit 12 is a residential apartment.

The living unit 12 has a floor 12A defining a floor space or area of the living unit 12, and a door 12B. The living unit 12 may include other features. The living unit 12 can also be other types of dwellings. Some non-limiting examples of a living unit 12 include a flat, condo, home, room, etc. Features of the overhead storage unit 10 (sometimes referred to herein simply as "storage unit 10") are displaceable so that one or more items to be stored within the storage unit 10 can be stored away when not in use, and so that access to the items can be provided. When stored away, features of the storage unit 10 are positioned such that they do not occupy the floor space of the floor 12A of the living unit 12. This allows the valuable floor space to be liberated and used for other purposes, thereby increasing to the overall usable floor space of the living unit 12. As will be described in greater detail herein, the storage unit 10 positions the items in an overhead storage area 16.

The overhead storage area 16 is disposed above the floor 12A of the living unit 12. More particularly, the overhead storage area 16 is located about the average level of the head of an occupant of the living unit 12. This position of the overhead storage area 16 allows the occupant to move freely about the living unit 12 without being obstructed by the storage unit 10. The configuration of the overhead storage area 16 can take different forms. For example, in FIG. 1A, the overhead storage area 16 is located above a closet 18 of the living unit 12. The closet 18 has studs 18A which form part of the framework of the living unit 12, and walls 18B which cover the studs 18A. The walls 18A and a door (not shown for the purposes of clarity) of the closet 18 delimit an enclosed space set apart from a remainder of the living unit 12.

In FIGS. 1A and 1B, the overhead storage area 16 is defined by the interconnected walls of an overhead structure 19 positioned on top of the closet 18. In alternate embodiments, the overhead storage area 16 is disposed adjacent to the ceiling, in a plenum area defined within a suspended ceiling and above the living unit 12. In another alternate embodiment, the overhead storage area 16 is defined by a lowered section of the ceiling that is continuous with the remainder of the ceiling of the living unit 12. It is therefore appreciated that many configurations of the overhead storage area 16 are within the scope of the present disclosure, provided that the overhead storage area 16 is raised above the floor 12A of the living unit 12 such that the storage unit 10, when stored within the overhead storage area 16, does not disrupt the movement of the occupant about the living unit 12. Features of the storage unit 10 are displaceable to raise the items into the overhead storage area 16 to store the items away, and to lower the items from the overhead storage area 16 to provide access to the items.

Referring to FIGS. 1A and 1B, the storage unit 10 includes a storage assembly 17 having multiple storage containers 20 for storing the items, and one or more guide members 30 for guiding displacement of the storage containers 20 between a stored position and an accessible position.

The storage containers 20 (only one shown in FIGS. 1A and 1B) can be any suitably shaped and sized object for holding and displacing the items. In the depicted embodiment, each storage container 20 includes a box-like storage structure 22 having an at least partially hollow interior 24 in which the items are stored. The storage structure 22 includes one or more interconnected walls 26, which include at least an interconnected wall 26A and outer walls 26B. The walls 26 are depicted as being planar bodies, but may be non-planar in other embodiments. Similarly, the interconnected and outer walls 26A, 26B are shown as being substantially uninterrupted along their length, but in alternate embodiments, one or both of the interconnected and outer walls 26A, 26B may be interrupted along their length. Thus each storage container 20 is a volume bounded on three or more sides to define an open or closed enclosure for receiving and storing the items.

Referring to FIGS. 2A to 2D, each storage container 20 has three walls 26A, 26B and is open along a front portion thereof to receive the items. In FIGS. 2A to 2D, the front portion of the storage containers 20 has an opening that is unobstructed by any structure, such as a door or panel. In an alternate embodiment, the front of the walls 26 of each storage container 26 has a door or drawer. The interconnected wall 26A and the outer walls 26B of each storage container 20 are interconnected along their common edges and are perpendicular with respect to one another. Suitable structures may be provided to reinforce the walls 26. For example, in FIGS. 2A to 2D and 7, the interconnected wall 26A and the outer walls 26B of each storage container 20 have straight frame members 27A attached to each other and to the interconnected wall 26A and the outer walls 26B, and a transverse bracing member 27B extending between some of the straight frame members 27A.

Figure 2A:
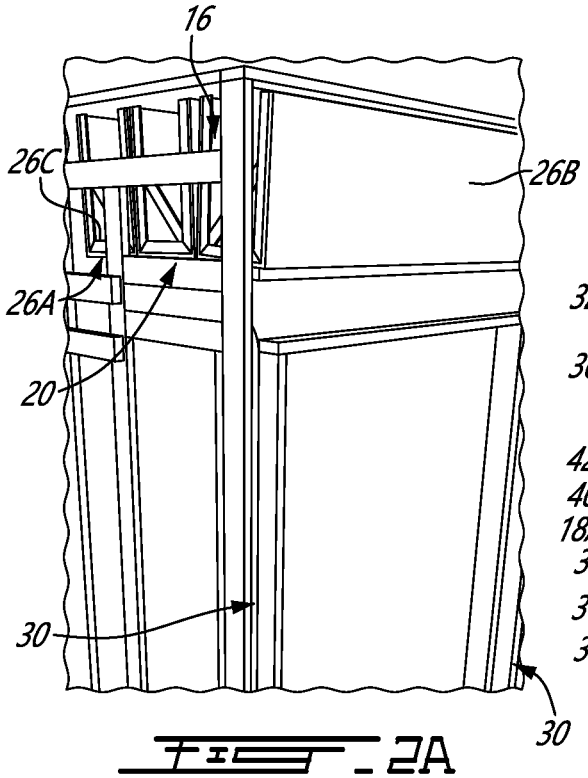
FIG. 2A is another perspective view of the overhead storage unit of FIG. 1A in the stored position, showing storage containers of the overhead storage unit.
Figure 2B:
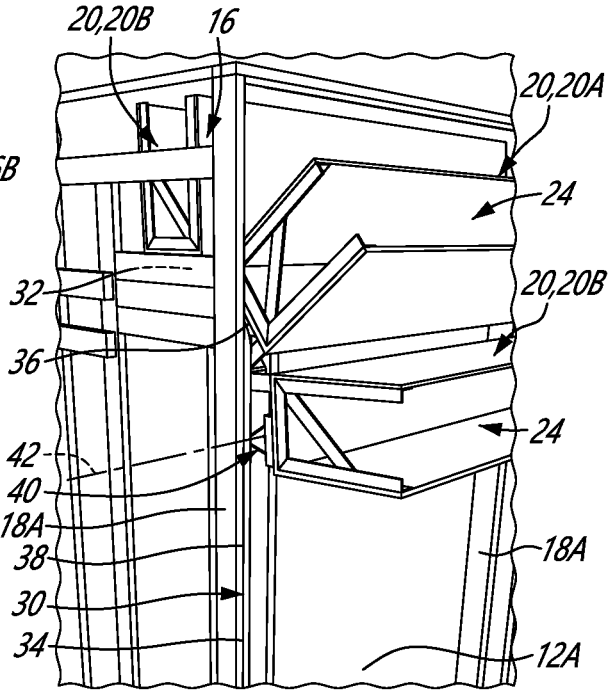
FIG. 2B is a perspective view of the overhead storage unit of FIG. 1A, showing the storage containers transitioning from the stored position.
Figure 2C:
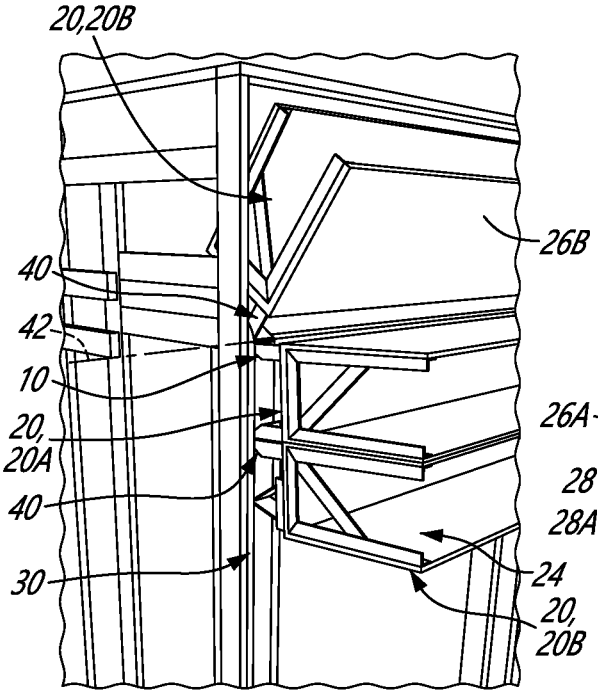
FIG. 2C is a perspective view of the overhead storage unit of FIG. 1A, showing the storage containers further transitioning from the stored position.
Figure 2D:
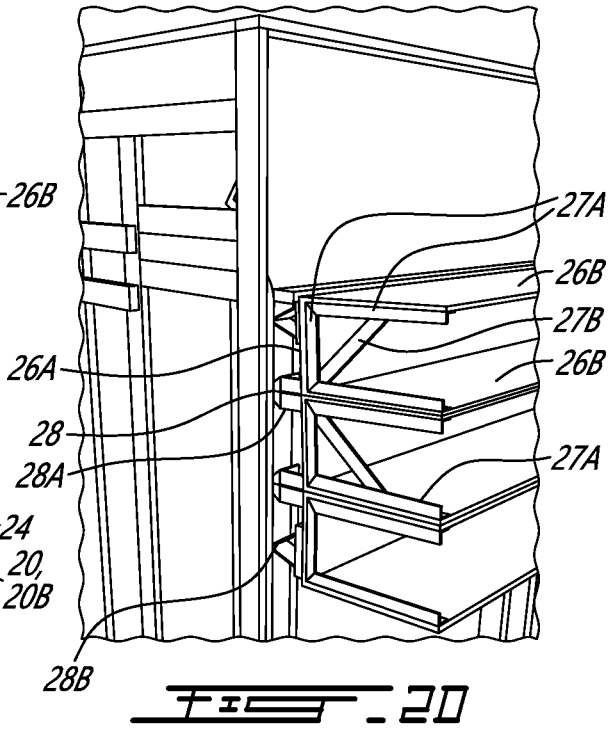
FIG. 2D is a perspective view of the overhead storage unit of FIG. 1A, showing the storage containers in an accessible position.

The interconnected wall 26A is the lowermost wall 26 of the storage structure 22 when each storage container 20 is in the stored position, as shown in FIG. 2A. The interconnected wall 26A has a first orientation such that it defines a bottom surface 26C of the storage container 20. In the depicted embodiment, the bottom surface 26C is the lowermost surface of each storage container 20 when it is in the stored position. One of the outer walls 26B is the lowermost wall 26 of the storage structure 22 when the storage container 20 is in the accessible position, as shown in FIG. 2D. The outer walls 26B can contribute to supporting the weight of the items stored within the storage structure 22 in the accessible position. The interconnected wall 26A can also contribute to supporting the weight of the items stored within the storage container 20 when in the stored position. The storage container 20 may include hooks, brackets, ties, mounts, or other devices to secure the items therein, and to prevent their displacement during movement of the storage container 20. In an embodiment, the storage container 20 has a door to provide access to the interior 24 and to the items therein. In FIGS. 2A to 2D, the storage container 20 is open along a front portion thereof to provide direct access to the interior 24 in the accessible position.

The walls 26 of the storage container 20 may be interconnected so as to define a hermetically-sealed interior 24. The sealed interior 24 prevents liquids and debris from exiting the storage container 20 during displacement thereof. Similarly, the storage container 20 may be made from any suitable material to confer impermeability, amongst other desired properties. The storage container 20 may be used to store any type of item.

Referring to FIGS. 2A to 2D, each storage container 20 is mounted to the one or more guide members 30. Each guide member 30 extends along a length to guide the displacement of the storage containers 20 along said length. More particularly, each guide member 30 has a first horizontal segment 32 mounted within the overhead storage area 16. In the depicted embodiment, the first segment 32 is mounted to an upper extremity of the closet 18 at a lower end of the overhead storage area 16. Each guide member 30 also has a second vertical segment 34 mounted below the overhead storage area 16. In the depicted embodiment, the second segment 34 is mounted to a lower extremity of the closet 18, such as to one of the walls 18B of the closet 18. The second segment 34 extends downwardly from the overhead storage area 16 to about the level of the floor 12A. Referring to FIGS. 2A-2D and 6, each guide member 30 also has a curved segment 36 extending between the first and second segments 32, 34. In the depicted embodiment, the curved segment 36 is downwardly curved to guide displacement of the storage containers 20 from the raised stored position to the lowered accessible position. Each segment 32, 34, 36 defines a portion of a pre-defined displacement path along which the storage containers 20 are guided when being displaced. The storage containers 20 are displaceable along each of the first, second and curved segments 32, 34, 36, along a direction of displacement or axis defined by the first, second and curved segments 32, 34, 36. The first, second, and curved segments 32, 34, 36 may be fixedly mounted to the studs 18A of the closet 18. In an alternate embodiment, the segments 32, 34, 36 are not mounted directly to a structure, but are free standing.

It will be appreciated that each guide member 30 can take any suitable form to accomplish the above-described functionality. For example, in the depicted embodiment, each guide member 30 includes a guide rail 38. FIGS. 2A and 2B show two laterally-spaced apart guide rails 38 mounted to opposed lateral sides or studs 18A of the closet 18. The storage containers 20 have rotatable guide bodies 28, which in the depicted embodiment are guide wheels 28A, mounted to an underside or rear of the storage containers 20. Each guide wheel 28A engages a corresponding one of the guide rails 38 to be displaced along the guide rail 38. The cooperation of the guide wheels 28A with the guide rails 38 allows the storage containers 20 to be displaced.

Other configurations for the guide member 30 are within the scope of the present disclosure. In an alternate embodiment, each guide member 30 includes an elongated rack and the storage containers 20 have a rotatable guide body that includes a gear, such as a pinion. Each guide body pinion engages a corresponding one of the racks to be displaced therealong. In another alternate embodiment, each guide member 30 includes a groove in a surface of the closet 18, for example, and the storage containers 20 have a rotatable guide body that includes a wheel. Each guide body wheel engages a corresponding one of the grooves to be displaced therealong. In another alternate embodiment, each guide member 30 includes a gliding surface, and the storage containers 20 have one or more skis that slide along the gliding surface. In another embodiment, each guide member 30 is an telescopic cylinder. In another embodiment, each guide member 30 includes a linear actuator. In another embodiment, each guide member 30 includes a pneumatic piston. Instead of multiple guide members 30, the storage containers 20 may be displaceable along only one guide member 30.

The displacement of the storage containers 20 along the guide member 30 changes the orientation of the storage containers 20. The storage containers 20 are displaceable to be raised to a stored position, and lowered to an accessible position.

In the stored position, and as shown in FIG. 2A, the storage containers 20 and the items are stored away. The storage containers 20 have a first orientation, which is vertical or facing upward. The interconnected walls 26A have a first orientation. In the depicted embodiment, the interconnected walls 26A lie horizontally within the overhead storage area 16 in the stored position. The storage container 20 and the items are therefore raised above the floor 12A of the living unit 12 to be stored away, thereby freeing up the floor space of the living unit 12. In the depicted embodiment, the storage containers 20 are on their "backs", such that the interconnected walls 26A of the storage containers 20 have a horizontal orientation and the outer walls 26B have an upright orientation. The storage containers 20 are shown resting on, and supported by, the first horizontal segment 32 of the guide members 30.

In the depicted embodiment, the overhead storage area 16 is concealed from view by the outer wall 26B of the forward-most storage container 20 when it is in the stored position, as shown in FIG. 2A. In an alternate embodiment, a part of the forward-most storage container 20 protrudes out of the overhead storage area 16 when the storage container 20 is in the stored position. Each storage container 20 is fully accessible in the accessible position, as shown in FIG. 2D. The change in orientation experienced by the outer walls 26B when pivoting to the accessible position allows the storage containers 20 to remain free of a door or other similar barrier that controls access to the storage container interior 24. Instead, access to the storage container interior 24 is provided by the simple change in orientation experienced by the outer walls 26B. The occupant is thus not required to open or close a door to hide/contain the items in the storage containers 20 or to obtain access thereto. The occupant is also not required to remember to close a door when placing the items in the storage containers 20 because the changing orientation of the outer walls 26B as they pivot toward the stored position will function to maintain the items within the storage container interiors 24.

In the accessible position, and as shown in FIG. 2D, the storage containers 20 and the items are accessible to the occupant. The storage containers 20 and/or the interconnected walls 26A have a second orientation that is different from the first orientation shown in FIG. 2A. In the depicted embodiment, the second orientation is offset from the first orientation by about 90°. The interconnected walls 26A are disposed upright below the overhead storage area 16 so that the occupant can access the items in the storage containers 20. The storage containers 20 and the items are therefore suspended in proximity to the floor 12A of the living unit 12. In the depicted embodiment, the interconnected walls 26A of the storage containers 20 have an upright orientation and the outer walls 26B have a horizontal orientation. The storage containers 20 are engaged with the second vertical segment 34 of the guide members 30. The storage containers 20 have a horizontal orientation.

It is thus appreciated that the interconnected and outer walls 26A, 26B, and indeed other walls 26 of the storage containers 20, undergo a change in orientation when the storage containers 20 are displaced between the stored and accessible positions. This change in the orientation of the storage containers 20 may be better appreciated by considering the dimensions of each storage structure 22 as it is displaced between the stored and accessible positions. Each storage structure 22 has a height, a length, and a width. In the stored position, the width of each storage structure 22 is measured in a horizontal plane and the height is measured along the outer walls 26B in a vertical plane. In the accessible position, the width of each storage structure 22 is measured in a horizontal plane and the height is measured along the interconnected wall 26A in a vertical plane.

This change in the orientation of the storage containers 20 between the stored and accessible positions allows the storage containers 20 to occupy a minimum volume of the overhead storage area 16 without compromising the interior 24 storage space for the items. More particularly, the storage containers 20 in the stored position have a substantially upright orientation, and are stacked next to one another in a direction parallel to the floor 12A. This may allow for a smaller overhead storage area 16 to be used, which may be particularly desirable in living units 12 which have low ceilings. Similarly, the horizontal orientation of the storage containers 20 in the accessible position allows full access to their interiors 24 by the occupant, at a lowered position that is comfortable for the occupant to load and unload the items from the storage containers 20.

Referring to FIGS. 2A to 2D, the storage containers 20 are each connected together to be raised and lowered together along the guide member 30. Each storage container 20 is connected to one or more of the other storage containers 20. This interconnection of the storage containers 20 may take different forms. For example, referring to FIG. 2C, the storage unit 10 has three storage containers 20: an inner storage container 20A and two outer storage containers 20B. The inner storage container 20A is connected to each of the outer storage containers 20B, and each of the outer storage containers 20B is connected to the inner storage container 20A. The outer storage containers 20B are not directly connected to each other.

The storage containers 20 are joined or connected at common pivots 40. Each pivot 40 is shared by the adjacent and connected storage containers 20, and defines a pivot axis 42 about which each of the connected storage containers 20 pivots or rotates. In FIGS. 2A to 2D, each of the outer storage containers 20B is joined to the inner storage container 20A with a common pivot 40. In FIGS. 2A to 2D, the storage assembly 17 includes two common pivots 40. The common pivots 40 and the pivot axes 42 move with the storage containers 20 as they are displaced between the stored and accessible positions. Other brackets, fasteners, joints or connectors may also connect two adjacent storage containers 20, such as additional bracing between adjacent storage containers 20.

While being displaced between the stored and accessible positions, each storage container 20 pivots relative to the adjacent connected storage container 20 on the common pivot 40 between the two storage containers 20 and about the common or shared pivot axis 42. By relatively pivoting, it is understood that each storage container 20 pivots about the common pivot axis 42 away from, or toward, the adjacent connected storage container 20. The distance separating the outer walls 26B of the adjacent and connected storage containers 20 therefore increases or decreases as a result of the relative pivoting motion. For example, and as shown in FIG. 2B, as the inner storage container 20A is displaced from the stored position toward the accessible position, it pivots relative to both of the outer storage containers 20B on the pivots 40 and about the pivot axes 42 that it shares with each of the outer storage containers 20B. Similarly, and referring to FIG. 2C, as the topmost outer storage container 20B is displaced from the stored position toward the accessible position, it pivots relative to the inner storage container 20A on the pivot 40 and about the pivot axis 42 that it shares with the inner storage container 20A. The storage containers 20 therefore articulate relative to each other as they are displaced between the stored and accessible positions.

Each storage container 20 is attached to one or more other storage containers 20. As the storage containers 20 are raised from the accessible position to the stored position (i.e. from the configuration shown in FIG. 2D to that shown in FIG. 2A), each of the storage containers 20 rotates from a horizontal to an upright position. As the storage containers 20 are lowered from the stored position to the accessible position (i.e. from the configuration shown in FIG. 2A to that shown in FIG. 2D), each of the storage containers 20 rotates from an upright to a horizontal position.

The overhead storage unit 10 thus has interconnected storage containers 20 which pivot relative to one another as they are raised or lowered together into the overhead storage area 16, and whose orientations change as they are moved. The interconnected storage containers 20 articulate relative to one another between a horizontal orientation and an upright orientation as they are raised into the overhead storage area 16.

Figure 8:
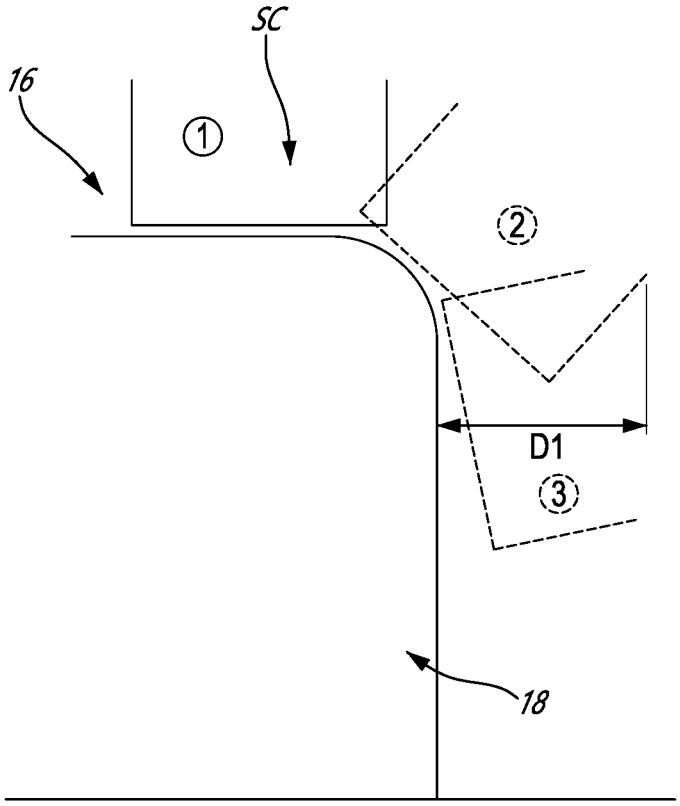
FIG. 8 is a schematic comparing movement of the overhead storage unit of FIG. 1 to another storage unit.
Figure 8:
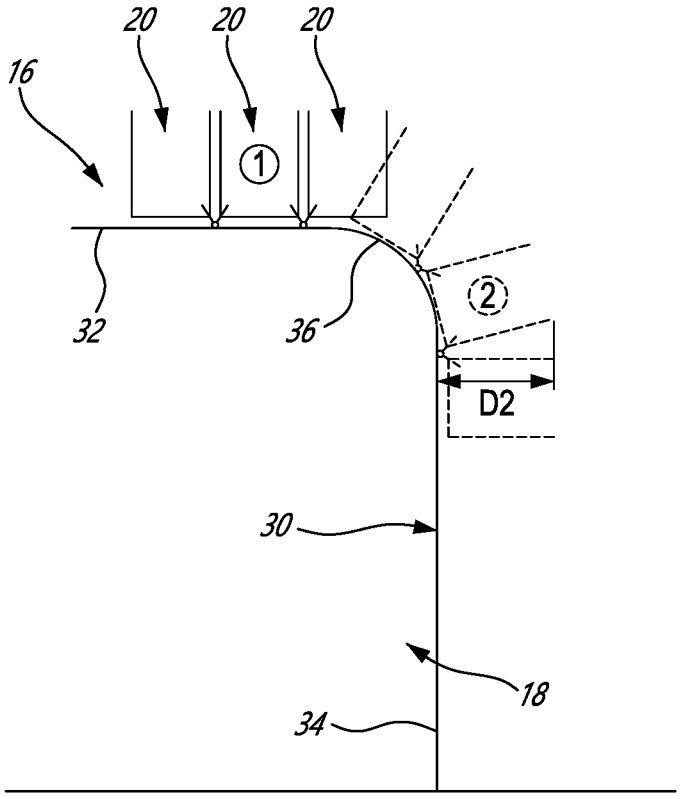

Having interconnected and articulating storage containers 20 reduces the distance that the storage containers 20 extend outwardly from the closet 18 and overhead storage area 16 as they are raised into the overhead storage area 16 and descended out of it. This is better shown in FIG. 8. In FIG. 8, the upper image shows a single overhead storage container SC having a storage volume and occupying an area of the overhead storage area 16. The lower image shows three interconnected and articulating storage containers 20 which collectively have the same storage volume and occupy the same area of the overhead storage area 16 as the overhead storage container SC. Referring to the upper image, as the storage container SC is lowered from the overhead storage area 16, and moves from position 1, to position 2 and then to position 3, one of its walls will extend outwardly from the closet 18 a maximum distance D1 from a wall of the closet 18. Referring to the lower image, as the storage containers 20 are lowered from the overhead storage area 16, and move from position 1 to position 2, one the outer walls 26B of each storage container 20 will extend outwardly from the closet 18 a maximum distance D2 from a wall of the closet 18. As can be seen, the distance D2 is less than the distance D1. Thus, the interconnected and articulating storage containers 20 extend or "jut" out less than a comparable one-compartment storage unit having the same storage volume and occupying the same area of the overhead storage area 16. The moment arm for the interconnected and articulating storage containers 20, measured from the motor or drive mechanism, is also shorter than it is for the overhead storage container SC, such that the motor or drive mechanism will need less energy to raise the interconnected and articulating storage containers 20 over the curved segment 36 of the guide member 30.

Since the interconnected and articulating storage containers 20 are separate from each other, each one of them can be lifted separately over the curved segment 36 of the guide member 30, which may require less energy than lifting the entire overhead storage container SC. Since the motor or drive mechanism is often sized based on the weight to lift over the curved segment 36, this may allow the interconnected and articulating storage containers 20 to support items having multiples of the weight of the items supported by the single overhead storage container SC. The interconnected and articulating storage containers 20 may also require less vertical clearance to enter the overhead storage area 16 when being raised compared to when the single overhead storage container SC is raised into the overhead storage area 16.

Referring to FIGS. 2A to 2D and 6, the curved segment 36 of each guide member 30 helps to change the orientation of at least the interconnected walls 26A. The curved segment 36 extends between the horizontal first segment 32 and the vertical second segment 34. From the stored position in which the interconnected walls 26A have the first orientation, they and the storage containers 20 are first displaced along the first segment 32 in a horizontal plane and then downwardly over the curved segment 36. The curved segment 36 changes the orientation of the interconnected walls 26A to the second orientation as it is being displaced such that the interconnected walls 26A are upright after having been displaced past the curved segment 36 and along the vertical second segment 34. The second orientation of the interconnected walls 26A is therefore offset from the first orientation by about 90°.

In the depicted embodiment, the rotatable guide bodies 28 of the storage container 20 include leading guide bodies 28B displaceable along corresponding guide members 30. The leading guide bodies 28B, shown in the depicted embodiment as leading guide wheels, engage two laterally-spaced apart guide members 30 so as to form a pair of leading guide bodies 28B. The leading guide bodies 28B are disposed adjacent to an upper end of the curved segment 36 of each guide member 30 when the storage containers 20 are in the stored position. By positioning the leading guide bodies 28B in proximity to the upper end of the curved segment 36, the effort required to lower the storage containers 20 from the stored position is reduced. Indeed, the close proximity of the leading guide bodies 28B to the upper end of the curved segment 36 means that the leading outer storage container 20B only has to travel a relatively short distance along the first segment 32 before the leading guide bodies 28B enter the curved segment 36, at which point gravity acting on the storage containers 20 will assist in lowering them from the stored position. This reduced effort is particularly useful if the storage containers 20 are manually displaced, as discussed in greater detail below.

The proximity of the leading guide bodies 28B to the upper end of the downwardly curved segment 36 can vary, depending on the desired effort required to lower the storage container 20, amongst other factors. For example, in the depicted embodiment, the leading guide bodies 28B have a default location within a downwardly curved portion of the curved segment 36 when the storage containers 20 are in the stored position. This positioning of the leading guide bodies 28B helps to bias the storage containers 20 downward, and thus helps to reduce the effort required to lower the storage containers 20. In such a configuration, tension may be applied to the storage containers 20 to hold them back and reduce the likelihood of it accidentally lowering. This tension can be provided by a cable, spring, or other mechanical device such as idling arms which remove slack in cables, or a pneumatic cylinder.

In an alternate embodiment, the leading guide bodies 28B are disposed at the onset of the downwardly curved portion of the curved segment 36 when the storage containers 20 are in the stored position. This positioning of the leading guide bodies 28B also helps to bias the storage containers 20 downward, and thus helps to reduce the effort required to lower the storage containers 20. In another alternate embodiment, the leading guide bodies 28B are disposed on the first segment 32 just before the junction of the first segment 32 and the curved segment 36. This positioning of the leading guide bodies 28B still facilitates lowering the storage containers 20, but more effort may be required than in the configuration where the leading guide bodies 28B are within the downwardly curved portion. Although the curved segment 36 has two downwardly curved portions, in an alternate embodiment, the curved segment 36 has only one downwardly curved portion along which the leading guide bodies 28B are displaced.

Figure 3A:
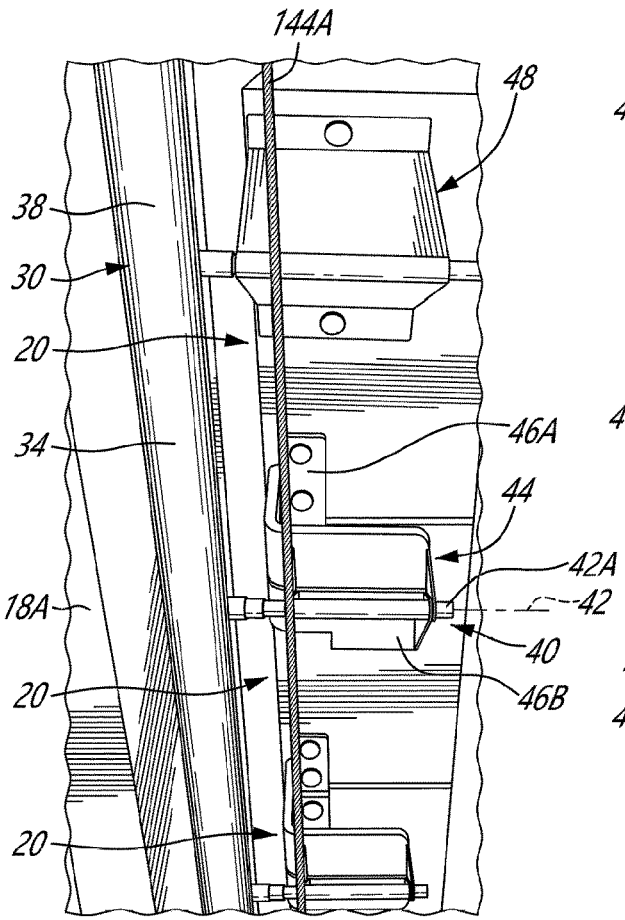
FIG. 3A is a perspective view of the storage containers of FIG. 2A and a guide member of the overhead storage unit of FIG. 1A.
Figure 3B:
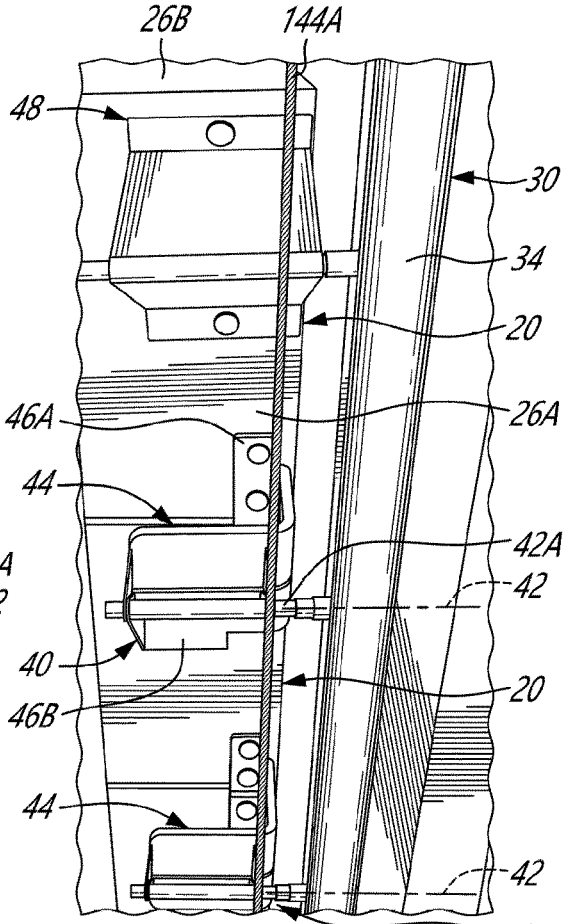
FIG. 3B is another perspective view of the storage containers of FIG. 2A and the guide member.
Figure 3C:
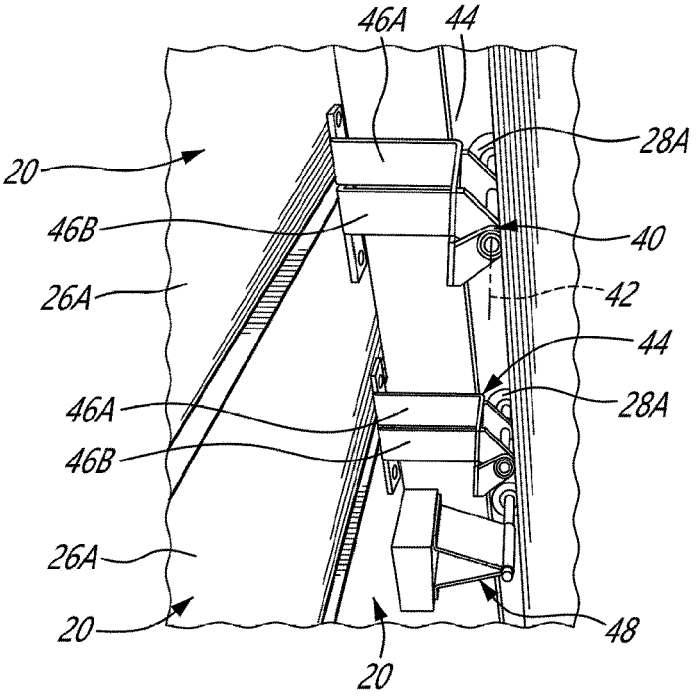
FIG. 3C is yet another perspective view of the storage containers of FIG. 2A and the guide member.

Referring to FIGS. 3A to 3C, the storage assembly 17 includes one or more brackets 44 which interconnect two adjacent storage containers 20. Each bracket 44 has a first arm 46A and a second arm 46B. The first arm 46A is mounted to one of the storage containers 20, such as to a rear surface of the interconnecting wall 26A of one of the storage containers 20. The second arm 46B is mounted to an adjacent storage container 20, such as to a rear surface of the interconnecting wall 26A of the adjacent and connected storage container 20. The first and second arms 46A, 46B are mounted to one of the common pivots 40. The first and second arms 46A, 46B are rotatable about the pivot axis 42 defined by the common pivot 40, thereby allowing the connected and adjacent storage containers 20 to also pivot about the common pivot axis 42. The storage containers 20 thus rotate or articulate about a common pivot 40 that is part of, or cooperates with, a bracket 44 that joins one storage container 20 to an adjacent storage container 20. The bracket 44 may take any suitable form, and interface in any suitable way with the common pivot 40, to achieve the above-described functionality. For example, The first and second arms 46A, 46B may have a common housing which is mounted on bearings supported by a pivot rod 42A which defines the pivot axis 42. The common pivots 40 or brackets 44 also have guide wheels 28A displaceable along the first, second, and curved segments 32, 34, 36 of the guide member 30. Referring to FIGS. 3A to 3C, a cable 144A is attached to one or more of the storage containers 20 or brackets 44 thereof. The cable 144A may be attached to other non-pivoting brackets 48 mounted to the storage containers 20 to guide their displacement. The cable 144A may be attached to a lowermost or uppermost storage container 20 or its bracket 44, 48.

Figure 4:
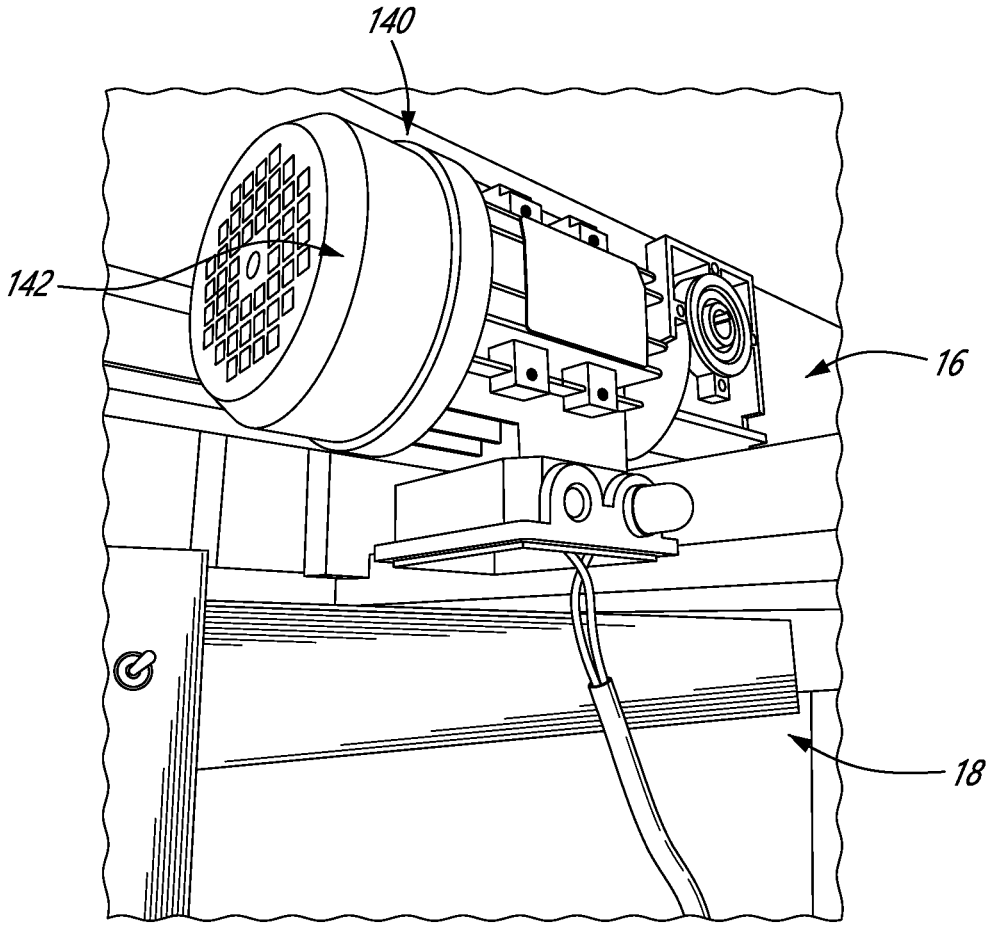
FIG. 4 is a perspective view of a motor of the overhead storage unit of FIG. 1A.
Figure 5:
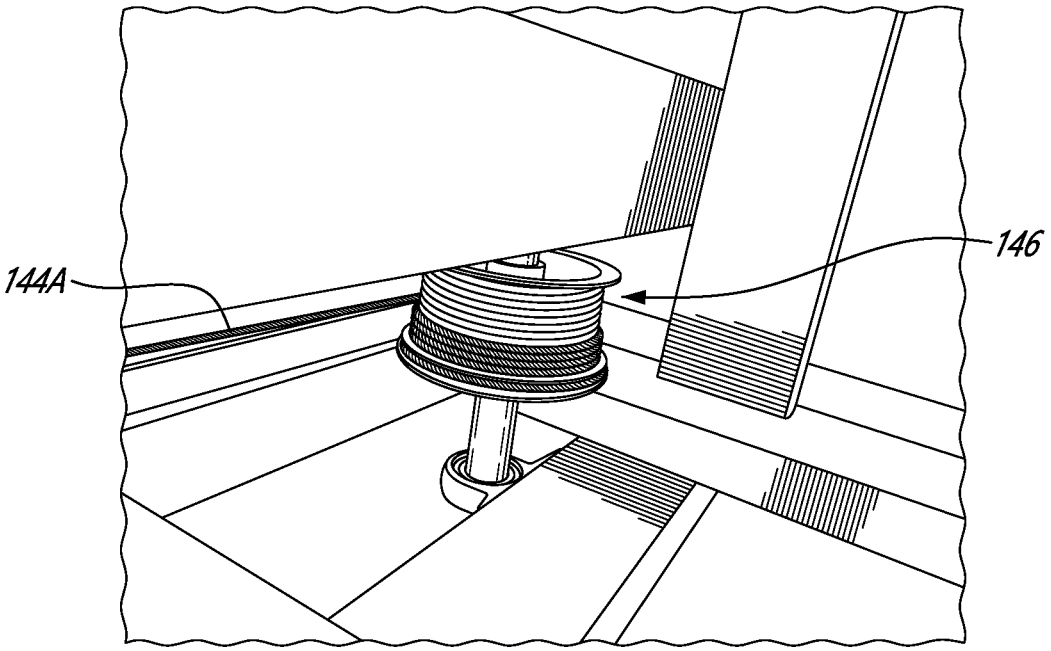
FIG. 5 is a perspective view of a pulley with a wound cable displaceable by the motor of FIG. 4.
Figure 6:
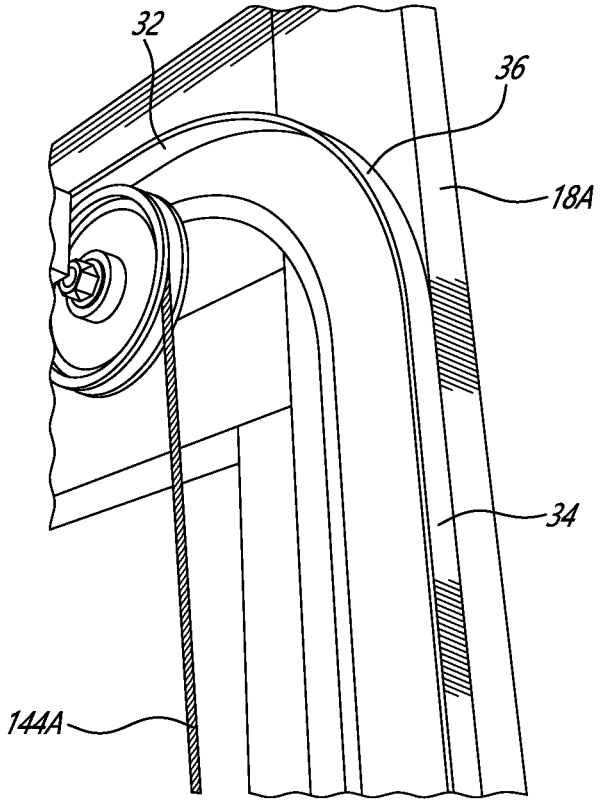
FIG. 6 is another perspective view of the guide member of the overhead storage unit of FIG. 1A.
Figure 7:
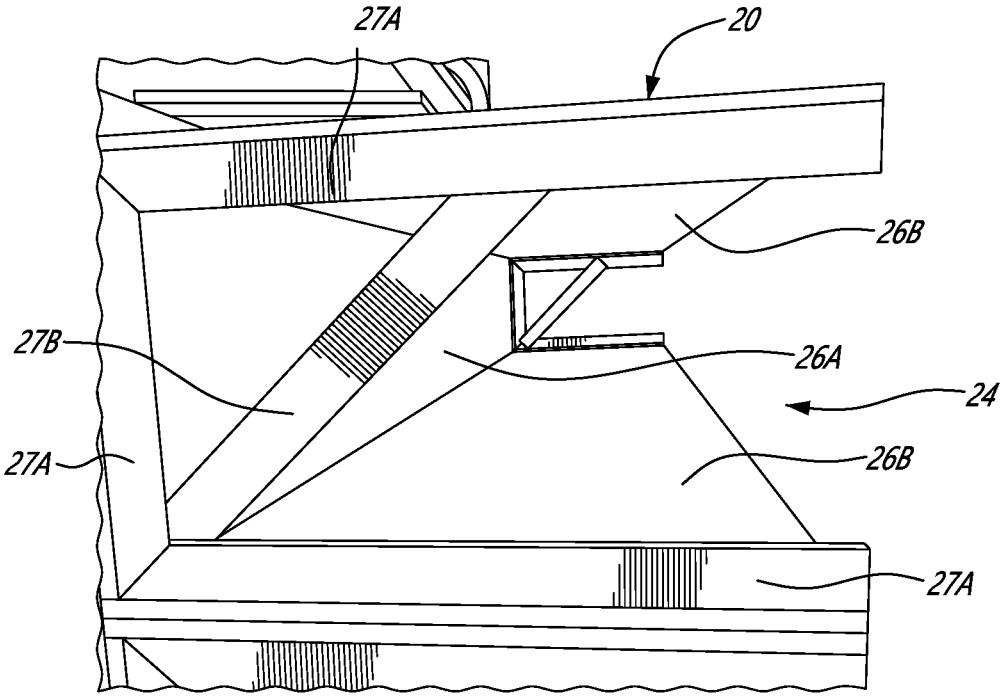
FIG. 7 is a side view of one of the storage containers of FIG. 2A.

Referring to FIGS. 4 and 5, the displacement of the storage containers 20 along the guide member 30 may be performed manually by the occupant, or with the assistance of motive power. Referring to FIG. 4, the storage unit 10 includes a motive power source. More particularly, the storage unit 10 has a motor assembly 140. The motor assembly 140 provides motive power to the storage containers 20 to displace them between the stored and accessible positions. In the depicted embodiment, and to optimise available space, the motor assembly 140 is mounted above the closet 18 in the overhead storage area 16. Acoustic tiles may be mounted below the motor assembly 140, and may be removed to service the motor assembly 140 from below. An acoustic or other concealing panel may be mounted in front of the motor assembly 140, which is positioned vertically between a top of the closet 18 and the interconnected walls 26A of the storage containers 20. The acoustic or other concealing panel may be removed to service the motor assembly 140 from the front. The motor assembly 140 includes a motor 142. Suitable brackets or mountings can be provided to secure the motor 142 in place. The motor 142 drivingly engages one or more displacement members, such as the cable 144A. The displacement members 144A are mounted to one or more of the storage containers 20 to displace them between the stored and accessible positions. The motor 142 may be controlled manually with a switch, or from a distance with a remote in communication with the motor 142 to control actuation thereof. The motor 142 may have a gearbox. The motor 142 may have a crank to be manually operated.

Referring to FIGS. 4 and 5, the displacement members 144A include motor cables 144A. The motor cables 144A are wound about a pulley 146 shown in FIG. 5, such that rotation of the pulley 146 causes the motor cables 144A to spool and unspool. An end of each motor cable 144A is attached to one or more of the storage containers 20 so that the spooling and unspooling of the motor cables 144A will cause the storage containers 20 to displace.

The displacement of the storage containers 20 with the motor assembly 140 occurs as follows. To lower the storage containers 20 from the stored position where they has the first orientation, the motor 142 performs a controlled unspool of the motor cables 144A by rotating the pulley 146 to unwind the motor cables 144A. This provides slack in the motor cables 144A allowing the storage containers 20 to descend based on gravity. To raise the storage containers 20 from the accessible position, the motor 142 draws in the motor cables 144A by rotating to spool them about the pulley 146. This removes slack from the motor cables 144A and applies tension thereto, causing the storage containers 20 to be raised along the guide member 30.

Other techniques are within the scope of the present disclosure for displacing the storage containers 20. In an alternate embodiment, the motive power is supplied by any other suitable type of drive, including, but not limited to, a crank with a manual mechanism and/or a spring balance. In an embodiment, the storage unit 10 includes a sensor to monitor displacement of the storage containers 20, and to prevent the storage containers 20 from being lowered too far. Similarly, the storage unit 10 may include a stop member to limit the downward displacement of the storage containers 20.

Referring to FIGS. 2A to 2D, there is also disclosed a method of storing items in the overhead storage area 16. The method includes loading the items in the storage containers 20 having an orientation beneath the overhead storage area 16. The method includes raising the storage containers 20 to be stored within the overhead storage area 16 by upwardly displacing the storage containers 20 along a pre-defined path. The upward displacement of the storage containers 20 changes their orientation to be different from their orientation when loading the storage containers 20. Each storage container 20 pivots relative to an adjacent interconnected storage container 20 about a pivot axis 42 common to both storage containers 20 during upward displacement thereof.

In light of the preceding, it can be appreciated that the storage unit 10 has storage containers 20 that are storable in an overhead position, which can be lowered and raised, and whose movements transforms the orientation of the storage containers 20 between the stored and accessible positions. When used in a relatively small living unit 12, the storage unit 10 helps to minimise the space occupied by items that need to be stored. In the accessible position, the storage containers 20 can be lowered to a convenient height to facilitate loading and unloading, thereby eliminating the necessity and inconvenience of a step ladder and potential injuries that may result should the occupant fall off the step ladder. By facilitating the storage and easy retrieval of items, the storage unit 10 helps to increase the available living space of the relatively small living unit 12. The storage unit 10 may also allow the occupant to store heavy items overhead that may otherwise be difficult or impossible to store overhead using only a step ladder.

The above description is meant to be exemplary only, and one skilled in the art will recognize that changes may be made to the embodiments described without departing from the scope of the invention disclosed. For example, the descriptive terms "horizontal", "vertical", and "upright" used herein do not limit the feature to being perfectly level or perfectly normal to a level plane. These features can deviate from the level and from the vertical provided that they remain substantially horizontal or vertical. Similarly, the storage assembly 17 is described herein and shown with its components assembled, but it will be appreciated that storage assembly 17 may be provided as a kit with its components disassembled, where the components are to be assembled in the residential living unit 12. Similarly, although the storage unit 10 is disclosed herein as being part of a residential living unit 12, it will be appreciated that the storage unit 10 may be used in other types of building units, such as commercial or industrial units. Still other modifications which fall within the scope of the present invention will be apparent to those skilled in the art, in light of a review of this disclosure, and such modifications are intended to fall within the appended claims.

The invention claimed is:

1. An overhead storage unit, comprising:

a guide member having a first horizontal segment mountable within an overhead storage area, a second vertical segment mountable below the overhead storage area, and a curved segment extending between the first and second segments; and a storage assembly having a plurality of storage containers each connected to at least one other storage container at common pivots, the storage containers mounted to the guide member and displaceable therealong to be raised and lowered between a stored position and an accessible position, each storage container pivoting relative to an adjacent storage container on the common pivot as the storage containers are displaced between the stored and accessible positions, the storage containers disposed within the overhead storage area and having a first orientation in the stored position, and the storage containers disposed below the overhead storage area and having a second orientation different from the first orientation in the accessible position.

2. The storage unit of claim 1, wherein the storage assembly includes one or more brackets having a first arm mounted to one of the storage containers and a second arm mounted to an adjacent storage container, the first and second arms mounted to one of the common pivots.

3. The storage unit of claim 1, wherein the common pivots have guide wheels displaceable along the first horizontal segment, the second vertical segment, and the curved segment of the guide member.

4. The storage unit of claim 1, comprising a cable attached to one or more of the storage containers, and a motor engaging the cable to draw the cable into the motor and displace the storage containers toward the stored position, the motor engaging the cable to release the cable from the motor to displace the storage containers toward the accessible position.

5. The storage unit of claim 1, wherein the second orientation is offset from the first orientation by about 90°.

6. The storage unit of claim 1, wherein the storage containers are disposed upright within the overhead storage area in the stored position, and have a horizontal orientation below the overhead storage area in the accessible position.

7. The storage unit of claim 1, wherein the storage containers include a plurality of rotatable guide bodies being displaceable along the guide member, a leading one of the guide bodies being disposed adjacent to the curved segment of the guide member when the storage containers are in the stored position.

8. The storage unit of claim 7, wherein the leading one of the guide bodies is disposed on a downwardly curved portion of the curved segment when the storage containers are in the stored position to bias the storage containers downward.

9. The storage unit of claim 1, further comprising a motor assembly having a motor drivingly engaging displacement members, said displacement members being mounted to the storage containers to displace the storage containers between the stored and accessible positions.

10. The storage unit of claim 9, wherein the displacement member includes a motor cable.

11. The storage unit of claim 9, wherein the motor assembly includes a remote in communication with the motor to control actuation thereof.

12. The storage unit of claim 1, wherein the guide member includes a plurality of laterally-spaced apart guide rails and the storage containers include a plurality of guide wheels each being displaceable along the guide rails, at least one of the guide wheels being disposed on a downwardly curved portion of the curved segment of a corresponding guide rail when the storage containers are in the stored position to bias the storage containers downward.

13. The storage unit of claim 1, wherein each storage container includes an interconnecting wall extending between outer walls, the interconnecting wall being perpendicular to the outer walls, the outer walls being oriented upright within the overhead storage area and the interconnecting wall being oriented horizontally within the overhead storage area upon the storage containers being in the stored position, and the outer walls being oriented horizontally below the overhead storage area and the interconnecting wall being oriented upright below the overhead storage area upon the storage containers being in the accessible position.

14. The storage unit of claim 1, wherein the walls of at least one of the storage containers are connected together to define a hermetically-sealed interior of said storage container.

15. A residential living unit, comprising:

an overhead storage area; and an overhead storage unit, comprising:

an elongated guide member having a first horizontal segment mounted within the overhead storage area, a second vertical segment mounted below the overhead storage area, and a curved segment extending between the first and second segments; and a storage assembly having a plurality of storage containers each connected to at least one other storage container at common pivots, the storage containers mounted to the guide member and displaceable therealong to be raised and lowered between a stored position and an accessible position, each storage container pivoting relative to an adjacent storage container on the common pivot as the storage containers are displaced between the stored and accessible positions, the storage containers disposed within the overhead storage area and having a first orientation in the stored position, and the storage containers disposed below the overhead storage area and having a second orientation different from the first orientation in the accessible position.

16. The living unit of claim 15, wherein the storage assembly includes one or more brackets having a first arm mounted to one of the storage containers and a second arm mounted to an adjacent storage container, the first and second arms mounted to one of the common pivots.

17. The living unit of claim 15, wherein the common pivots have guide wheels displaceable along the first horizontal segment, the second vertical segment, and the curved segment of the guide member.

18. The living unit of claim 15, comprising a cable attached to one or more of the storage containers, and a motor engaging the cable to draw the cable into the motor and displace the storage containers toward the stored position, the motor engaging the cable to release the cable from the motor to displace the storage containers toward the accessible position.

19. The living unit of claim 15, wherein the second orientation is offset from the first orientation by about 90°.

* * * * *